US007423498B2

(12) United States Patent
Dalconzo et al.

(10) Patent No.: US 7,423,498 B2
(45) Date of Patent: Sep. 9, 2008

(54) COMPACT MULTILAYER CIRCUIT

(75) Inventors: Lawrence Dalconzo, Los Angeles, CA (US); Christopher A. Moye, El Segundo, CA (US); Eduardo D. Barrientos, Jr., Carson, CA (US); David J. Drapeau, Los Angeles, CA (US); Michael T. Crnkovich, Torrance, CA (US); Tamrat Akale, Azusa, CA (US)

(73) Assignee: Raytheon Company, Waltham, MA (US)

( * ) Notice: Subject to any disclaimer, the term of this patent is extended or adjusted under 35 U.S.C. 154(b) by 343 days.

(21) Appl. No.: 11/230,382

(22) Filed: Sep. 20, 2005

(65) Prior Publication Data

US 2007/0063789 A1 Mar. 22, 2007

(51) Int. Cl.
*H01P 1/10* (2006.01)
*H01P 1/20* (2006.01)
*H01P 1/204* (2006.01)

(52) U.S. Cl. ..... 333/101; 333/104; 333/204

(58) Field of Classification Search ..... 333/101, 333/103, 104, 105, 204, 205
See application file for complete search history.

(56) References Cited

U.S. PATENT DOCUMENTS 5,471,181 A 11/1995 Park
5,525,942 A 6/1996 Horii et al.
5,783,976 A 7/1998 Furutani et al.
6,414,570 B1 * 7/2002 Dalconzo et al. ..... 333/202
7,084,722 B2 * 8/2006 Goyette ..... 333/204
2003/0234706 A1 12/2003 Silk et al.

* cited by examiner

*Primary Examiner*—Dean Takaoka
(74) *Attorney, Agent, or Firm*—Leonard Alkov

(57) ABSTRACT

A compact multilayer signal processing system. In the illustrative embodiment, the system is adapted for use with microwave signals. The system includes a first mechanism for receiving an input signal and selectively routing the input signal onto a first signal path. A second mechanism routes the input signal along the first signal path vertically through one or more layers to a first circuit component. The first circuit component outputs an adjusted signal in response to receipt of the input signal. A third mechanism directs the adjusted signal to the output of the system. In a specific embodiment, the one or more layers include one or more groundplane layers. In this embodiment, the first mechanism includes an input switching network in communication with a controller. The switching network is positioned on a switching layer and communicates with one or more controllers to facilitate selectively switching the input signal onto one of plural input signal paths. The second mechanism further includes a first input waveguide that extends from the input switching network vertically through at least one groundplane layer and to an input end of the first circuit component. The third mechanism includes a first output waveguide extending from an output end of the first circuit component, vertically through at least one groundplane layer to an output switching network disposed on the switching layer. In the specific embodiment, the circuit layer includes plural circuit components that are coupled to respective input waveguides and output waveguides that extend vertically through the first groundplane layer to the input switching network and the output switching network, respectively.

6 Claims, 3 Drawing Sheets

COMPACT MULTILAYER CIRCUIT

BACKGROUND OF THE INVENTION

1. Field of Invention

This invention relates to circuits. Specifically, the present invention relates to systems and methods for packaging and isolating circuits, such as microwave frequency converter circuits.

2. Description of the Related Art

Circuit isolation and packaging systems are employed in various demanding applications including microwave filter banks. Such applications demand compact packaging that minimizes electrical interference between components.

Compact circuit isolation systems are particularly useful in microwave frequency converters and filter banks, where crosstalk between switches, filters, amplifiers, and signal converters is especially problematic. Conventionally, microwave frequency-shifter components are individually packaged in expensive double-sided cavitized housing assemblies, which are interconnected via wire, ribbon, and/or solder interconnects. Such component assemblies are often undesirably large and expensive. Furthermore, the various interconnects are prone to breakage, which reduces system reliability.

Hence, a need exists in the art for a cost-effective and space-efficient system and method for assembling and packaging circuit components requiring electrical isolation.

SUMMARY OF THE INVENTION

The need in the art is addressed by the compact multilayer signal processing system of the present invention. In the illustrative embodiment, the system is adapted for use with microwave signals. The system includes a first mechanism for receiving an input signal and selectively routing the input signal onto a first signal path. A second mechanism routes the input signal along the first signal path through one or more layers, including one or more groundplane layers, to a first circuit component for modifying the input signal and providing an adjusted signal in response thereto. A third mechanism outputs the adjusted signal.

In a specific embodiment, the first mechanism includes an input switching network in communication with one or more controllers for selectively switching the input signal onto one of plural input signal paths. The switching network is positioned on a switching layer. The second mechanism accommodates a first input signal that extends from the input switching network through at least one groundplane layer and to an input end of the first circuit component. The third mechanism accommodates a first output signal extending from an output end of the first circuit component, through the at least one groundplane layer and to an output switching network disposed on the switching layer. In the specific embodiment, the input switching network and the output switching network are microstrip switching networks. The first circuit component is a stripline circuit component that is disposed on a circuit layer. The circuit layer is positioned between a first groundplane layer and a second groundplane layer.

In a more specific embodiment, the first circuit component is a microwave filter. The circuit layer includes plural circuit components that are each coupled to a respective input waveguide and output waveguide that extend through the first groundplane layer to the input switching network and the output switching network, respectively.

In the illustrative embodiment, the system further includes one or more controllers coupled to the input switching network and/or to the output switching network. The one or more controllers are adapted to selectively activate or select a desired circuit component disposed on the circuit layer in response to a given operational mode of the multilayer signal processing system. The system further includes one or more additional circuit layers disposed substantially adjacent to and parallel to the second groundplane layer on a side of the second groundplane layer opposite the circuit layer. The one or more additional circuit layers include one or more additional microwave filters disposed therein. The various waveguides, including the first input waveguide and the first output waveguide, are equipped with mode-suppression holes that parallel the waveguides, which are circular waveguides.

One embodiment of the present invention is a stacked multilayer microwave filter with several filter elements. The unique positioning of the filter elements between or adjacent to groundplanes facilitates improved input/output isolation and significantly reduces the form factor required to implement the filter. Versatility and scalability of the filter is enhanced via use of unique input and output switching networks. The switching networks can switch a filter input signal to an appropriate layer and accompanying filter element and then selectively output the resulting filtered output signal while achieving minimal interference and maximum electrical isolation between filter input and output terminals. The vertical waveguides that couple the filter elements to the switching networks and that extend through one or more layers of the filter are equipped with special mode-suppression holes that further enhance filter response characteristics.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
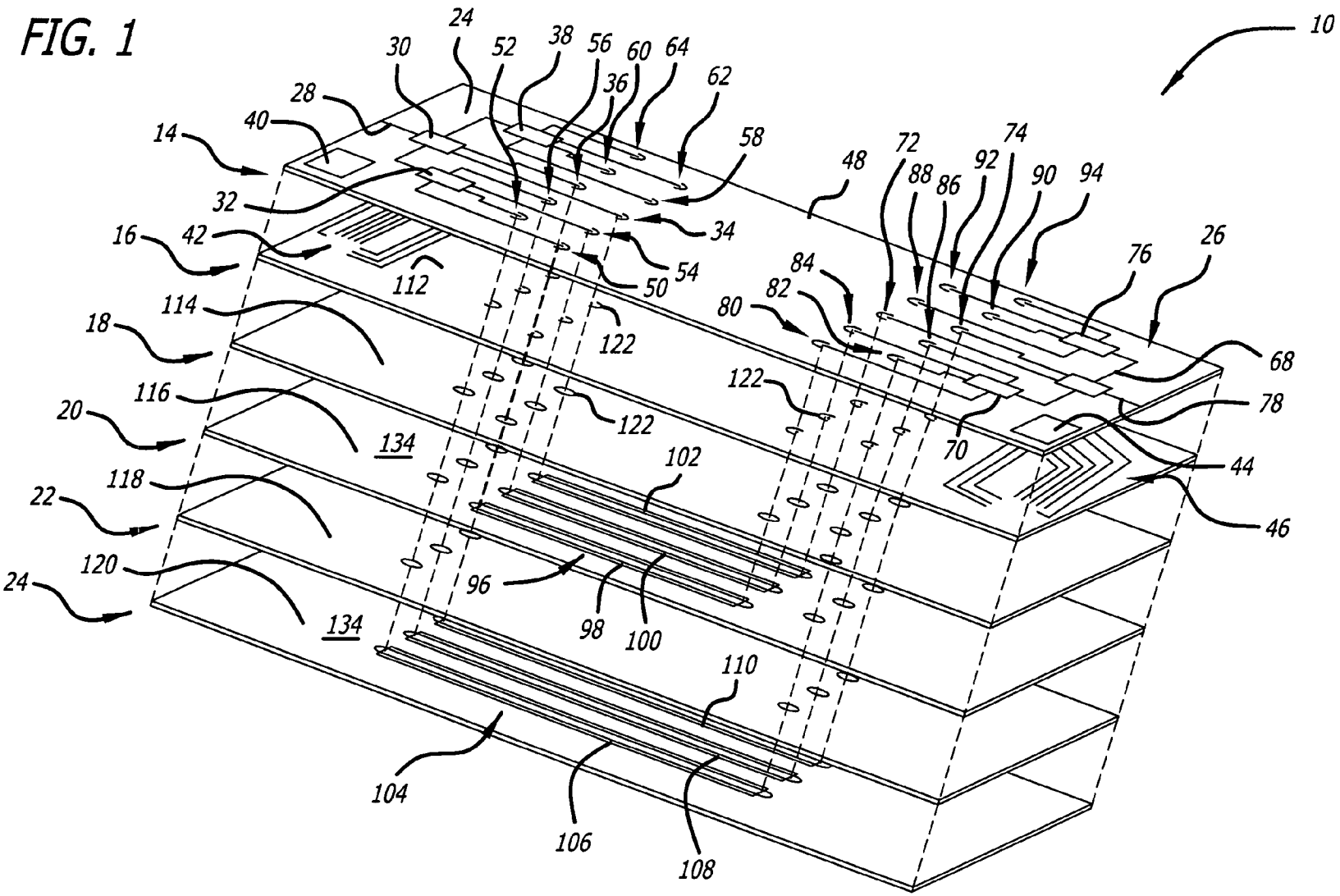
FIG. 1 is an exploded view of a stacked multilayer programmable microwave filter according to an embodiment of the present invention.

FIG. 1 is an exploded view of a stacked multilayer programmable microwave filter 10 according to an embodiment of the present invention. For clarity, various well-known components, such as power supplies, antennas, and so on, have been omitted from the figures. However, those skilled in the art with access to the present teachings will know which components to implement and how to implement them to meet the needs of a given application.

The stacked programmable microwave filter 10 includes, from top to bottom, a switching layer 14, a control-routing layer 16, a first groundplane layer 18, a first filter layer 20, a second groundplane layer 22, and a second filter layer 24. The various layers 14-24 are approximately parallel and coincident as shown in FIG. 1. The various layers 14-24 have a low-loss dielectric substrate core, which in the present embodiment is Duroid. Duroid may be ordered from Rogers Corp.

The switching layer 14 includes an input switching network 24 and an output switching network 26, which are positioned on opposite ends of a top surface 48 of the switching layer 14. The switching networks 24, 26 are implemented via microstrip with a common groundplane implemented via the first groundplane layer 18.

The input switching network 24 includes an input terminal 28 for receiving an input microwave signal. In the present specific embodiment, the input terminal 28 connects to an input of a first 1-4 switch 30. The first 1-4 switch 30 selectively provides input to a second 1-4 switch 32, a first vertical RF transition 34, a second vertical RF transition 36, and a third 1-4 switch 38.

The second 1-4 switch 32 selectively provides input to a third vertical RF transition 50, a fourth vertical RF transition 52, a fifth vertical RF transition 54, and a sixth vertical RF transition 56. The third 1-4 switch 38 selectively provides input to a seventh vertical RF transition 58, an eighth vertical RF transition 60, a ninth vertical RF transition 62, and a tenth vertical waveguide RF transition 64. The 1-4 switches 30, 32, 38 are responsive to control signals received from a first Application-Specific Integrated Circuit (ASIC) controller 40. The control signals are routed through the control-routing layer 16 via a first set of routing paths 42, which are connected to the first ASIC controller and to the input switching network 24 via vertical connections (not shown) extending through the switching layer 14.

The output switching network 26 includes a first 4-1 switch 68, an output of which represents the output of the programmable stacked microwave filter 10 as provided at an output terminal 78. In response to receipt of control signals from a second controller 44, the 4-1 switch 68 selectively switches inputs from a second 4-1 switch 70, a first output vertical RF transition 72, a second output vertical RF transition 74, and a third 4-1 switch 76 to the output terminal 78.

The second 4-1 switch 70 selectively switches input from third, fourth, fifth, and sixth output vertical RF transitions 80-86, respectively, to an input of the first 4-1 switch 68 in response to receipt of specific control signals from the second controller 44. Similarly, the third 4-1 switch 76 selectively switches input from seventh, eighth, ninth, and tenth vertical RF transitions 88-94, respectively, to an input of the first 4-1 switch 68.

The various switches 68, 70, 76 are responsive to control signals received from the second ASIC controller 44. The control signals are routed through the control-routing layer 16 via a second set of routing paths 46, which are connected to the second ASIC controller and to the output switching network 26 via vertical connections (not shown) extending through the switching layer 14.

The first, third, fifth, seventh, and ninth input vertical RF transitions 34, 50, 54, 58, 62, respectively, extend approximately perpendicularly through the switching layer 14, the control-routing layer 16, and the first groundplane layer 18 to the first filter layer 20. At the first filter layer 20, the input vertical RF transitions 34, 50, 54, 58, 62 couple to inputs of five respective first-layer filter elements 96, three of which are visible in FIG. 1. The three visible first-layer filter elements include a first filter element 98, a second filter element 100, and a third filter element 102, which are coupled to the third input vertical RF transition 50, the fifth input vertical waveguide 54, and the first input vertical waveguide 34, respectively.

The corresponding first, third, fifth, seventh, and ninth output vertical RF transitions 72, 80, 84, 88, 92, respectively, extend approximately perpendicularly through the switching layer 14, the control-routing layer 16, and the first groundplane layer 18, and couple to outputs of the respective first-layer filter elements 96. Outputs of the first filter element 98, second filter element 100, and third filter element 102 are coupled to the third output vertical RF transition 80, fifth output vertical RF transition 84, and the first output vertical RF transition 74, respectively.

The second, fourth, sixth, eighth, and tenth input vertical RF transitions 36, 52, 56, 60, 64, respectively, extend approximately perpendicularly through the switching layer 14, the control-routing layer 16, the first groundplane layer 18, the first filter layer 20, and the second groundplane layer 22. The input vertical RF transitions, 36, 52, 56, 60, 64 couple to inputs of five respective second-layer filter elements 104, three of which are visible in FIG. 1. The three visible second-layer filter elements include first, second, and third second-layer filter elements 106, 108, 110, respectively. Inputs of the visible second-layer filter elements 106, 108, 110 are coupled to the fourth input vertical RF transition 52, the sixth input vertical waveguide 56, and the second input vertical RF transition 36, respectively.

The second, fourth, sixth, eighth, and tenth output vertical RF transitions 74, 82, 86, 90, 94, respectively, extend approximately perpendicularly through the switching layer 14, the control-routing layer 16, the first groundplane layer 18, the first filter layer 20, and the second groundplane layer 22. The output vertical RF transitions 74, 82, 86, 90, 94 couple to outputs of the five respective second-layer filter elements 104. Outputs of the visible second layer filter elements 106, 108, 110 are coupled to the fourth output vertical RF transition 82, the sixth output vertical RF transition 86, and the second output vertical RF transition 74, respectively.

In the present specific embodiment, the control-routing layer 16 is constructed substantially from dielectric material, such as Duroid. A top surface 112 of the control-routing layer 16 is shown lacking surface metalization, but exhibiting plated through holes, i.e., coaxial structures corresponding to the various vertical RF transitions, such as the input vertical waveguides 34, 36, 50-56 shown.

In the present embodiment, the first groundplane layer 18 is implemented via a dielectric substrate exhibiting a first metal-plated top surface 114 with vertical RF transition holes therein, which correspond to the various vertical RF transitions 34, 36, 50-64, 74, 76, 80-94. Similarly, the second groundplane layer 22 is implemented via a dielectric substrate exhibiting a second metal-plated top surface 118 with vertical RF transition holes therein. The second filter layer 24 also exhibits a metallic surface 120 disposed on a dielectric core.

In the filter 10 of FIG. 1, the various vertical waveguides 34, 36, 50-64, 74, 76, 80-94 are shown extending perpendicularly through the various horizontal layers 14-24. However, the various vertical RF transitions 34, 36, 50-64, 74, 76, 80-94 may extend vertically through the horizontal layers 14-24 at an angle through the layers 14-24 without departing from the scope of the present invention. For the purposes of the present discussion, the term vertically through is taken to mean either perpendicularly through or at an angle through.

The first filter layer 20 exhibits a dielectric core with a top surface metalization 116 with strategically cleared areas corresponding to the filter elements 96. Metalization within the strategically cleared areas is shaped to provide desired filtering operations on microwave signals passing through the filter elements 96. The second filter layer 24 is constructed similarly to the first filter layer 20 with the exception that the metallic surface 120 of the second filter layer 24 lacks waveguide holes therethrough.

The filter elements 96, sandwiched between the first groundplane layer 114 and the second groundplane layer 118, are stripline filter elements. Consequently, the filter elements 96 are homogenous and exhibit improved filter responses over certain other conventional filter elements. The second filter layer 24 is constructed similarly to the first filter layer 20, with the exception that no waveguide holes through the second filter layer 24 are needed.

In operation, the ASIC controllers 40, 44 configure the input switching network 24 and the output switching network 26 to select a particular filter element from the filter elements 96 of the first filter layer 20 or from the filter elements 104 of the second filter layer 104. A particular filter element is selected when the appropriate switches of the input network 24 and the output network 26 enable an input signal to pass through the input switching network 14; through a corresponding input vertical RF transition; through the selected filter element; through the corresponding output vertical waveguide; and through the output switching network 26 to the output terminal 78.

In the present specific embodiment, the compact stacked filter 10 configuration is adapted to filter electromagnetic energy within a microwave frequency band, such as between 4-15 GHz. Furthermore, in the present embodiment, only one filter element at a time is selected via the controllers 40, 44.

Strategic use of the input switching network 24 and the output switching network 26 in combination with the use of groundplane layers 18, 22 between the input/output terminals 28,78 and a selected filter element greatly enhance electrical isolation between the terminals 28, 78 and between the input and output of the selected filter element. This obviates the need for special independent adjacent cavatized housings for each filter element to ensure sufficient input/output isolation. Consequently, the footprint of the filter 10 significantly reduces filter space requirements, which is very important in various applications including missile, aircraft, and satellite systems.

Note that various layers, including the filter layers 20, 24 are coated with metal 134. The metalization 134 is connected to all ground planes 18, 22, which further improves signal isolation and cross talk. Note that the bottom filters 104-110 are stripline filters. Consequently, an additional groundplane layer (not shown) is included below the bottom filter layer 24.

The ASIC controllers 40, 44 store information about filtering characteristics of each filter element 96, 104 and run algorithms that choose the appropriate filter for a given signal environment. In addition, the ASIC controllers 40, 44 may send tuning signals, via the routing paths 42, 46, to various circuit paths extending to/from the switches 30, 32, 38 and switches 68, 70, 76 to improve overall filter performance. Tuning signals may be computed by the ASIC controllers 40, 44 based on a predetermined algorithm that may be readily developed by those skilled in the art with access to the present teachings without undue experimentation.

In the present embodiment, the ASIC controllers 40, 44 select the appropriate filter elements 96, 104 according to the frequency of electromagnetic energy that is provided to the input terminal 28. The controllers 40, 44 may communicate with a frequency-measuring device (not shown). Alternatively, appropriate functionality may be built into the controllers 40, 44, to facilitate determining the frequency of the input signal to facilitate selecting the appropriate filter element 96, 104 accordingly. Alternatively, the controllers 40, 44 may be manually pre-configured to select a particular filter element 96, 104. The controllers 40, 44 and accompanying algorithm may be implemented via a user-programmable computer or other ASIC by those skilled in the art without undue experimentation.

In the present specific embodiments, the various vertical RF transitions 34, 36, 50-64, 74, 76, 80-94 exhibit mode-suppression holes, which are optimized to suppress undesirable signal modes travelling in the vertical RF transitions as discussed more fully below. The mode suppression holes 122 are implemented via metal-metal-plated through holes running substantially parallel to the vertical RF transitions 34, 36, 50-64, 74, 76, 80-94. In this embodiment, the vertical RF transitions 34, 36, 50-64, 74, 76, 80-94 are implemented via coaxial structures or circular waveguides. Waveguides other than circular waveguides may be employed without departing from the scope of the present invention.

Those skilled in the art will appreciate that the stacked filter 10 may be scaled to accommodate additional layers, additional filter elements per layer, or fewer layers with fewer filter elements per layer without departing from the scope of the present invention. Furthermore, the filter elements 96, 104 may be replaced with other types of circuit components, such as frequency converters, amplifiers, and so on, without departing from the scope of the present invention.

In the present specific embodiment, interfacing between the switching networks 24, 26 and the vertical RF transitions are implemented via stripline-to-circular transitions. Similarly, interfacing between the vertical RF transitions 34, 36, 50-64, 74, 76, 80-94 and the filters 96-102, 104-110 are implemented via circular-to-stripline transitions. Conventional stripline-to-circular transitions and/or circular-to-stripline transitions may be employed without departing from the scope of the present invention.

Those skilled in the art will appreciate that the stacked programmable microwave filter 10 may be adapted for use with electromagnetic energy exhibiting frequencies other than microwave frequencies without departing from the scope of the present invention. Furthermore, the various microwave filters 96, 104 may be replaced with circuit components other than filters, such as amplifiers, frequency converters, and so on, without departing from the scope of the present invention. In addition, the switching networks 24, 26 may be replaced with different types of switching networks. For example, the 1-4 switches 30, 32, 38 may be replaced with a single 1-10 switch. A 1-20 switch could be employed in implementations wherein the stacked filter 10 exhibits twenty filter elements.

The unique use of the switching networks 24, 26 in combination with a stacked approach exhibiting isolation-enhancing groundplanes 18, 22 yields compact circuit implementations while minimizing cross-talk between components and maximizing electrical isolation between the input terminal 28 and the output terminal 78.

Figure 2:
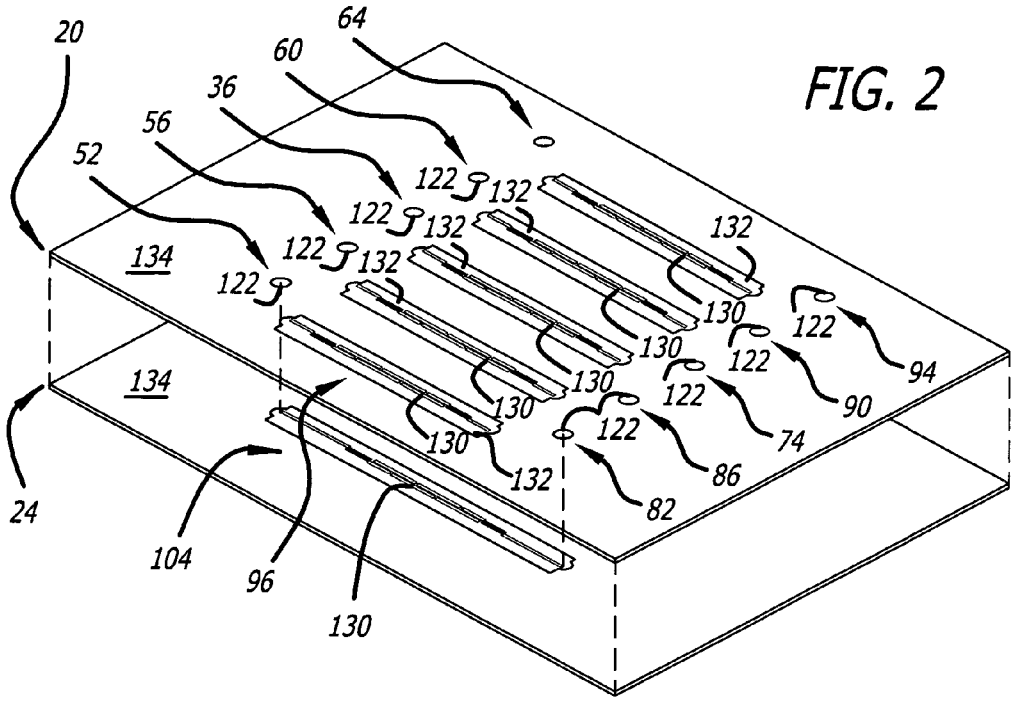
FIG. 2 is a magnified view illustrating filter layers of the stacked multilayer programmable filter of FIG. 1.

FIG. 2 is a magnified exploded view illustrating filter layers 20, 24 of the stacked multilayer programmable filter of FIG. 1. For clarity, the intervening groundplane layer 22 of FIG. 1 is not shown in FIG. 2.

In the present specific embodiment, the five first-layer filter elements 96 and the five second-layer filter elements 104 are implemented as stripline filter elements with strategically patterned filter metalization 130 surrounded by clearance areas 132 in surrounding metal surfacing 134. Various input vertical RF transitions 52, 56, 36, 60, 64 and output vertical RF transitions 82, 86, 74, 90, 94 and accompanying mode-suppression holes 122 are more clearly visible in FIG. 2.

Figure 3:
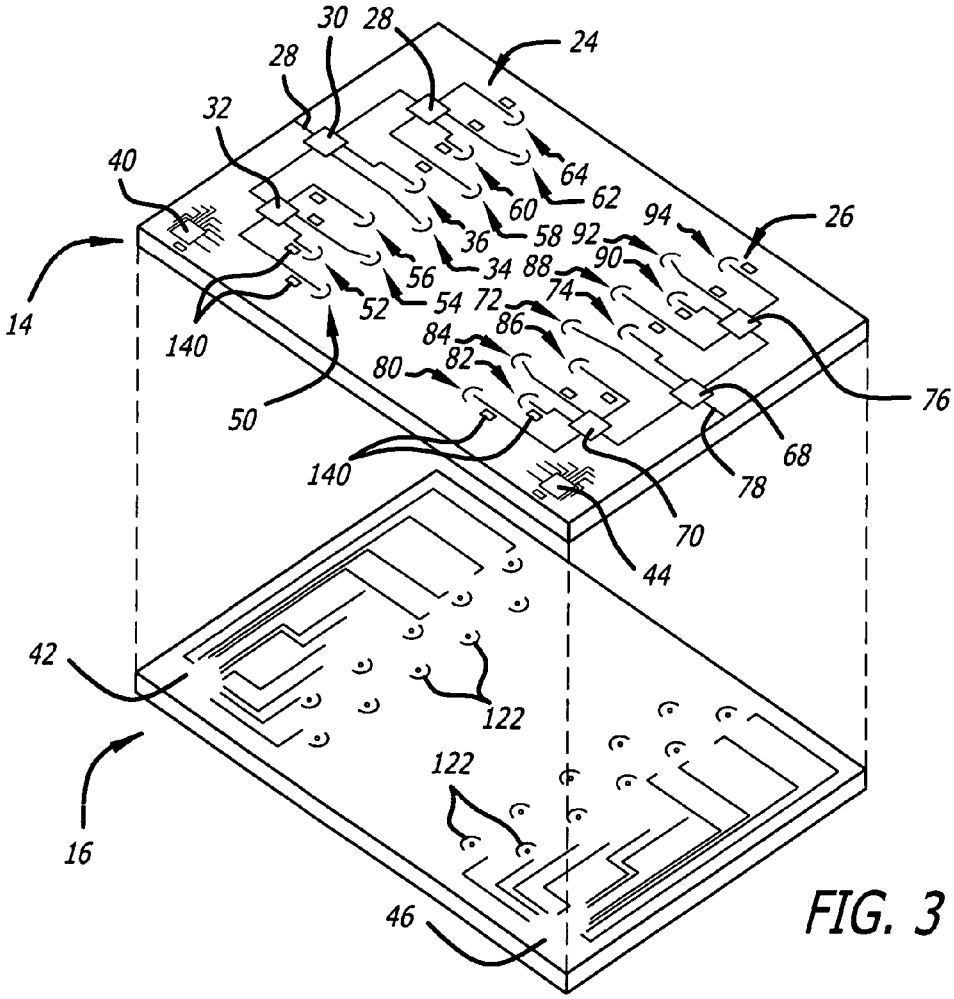
FIG. 3 is a more detailed view illustrating a Radio Frequency (RF) switching layer and control signal routing layer of the stacked multilayer programmable filter of FIG. 1.

FIG. 3 is a more detailed view illustrating a Radio Frequency (RF) switching layer 14 and control-routing layer 16 of the stacked multilayer programmable filter 10 of FIG. 1. The first ASIC controller 40 connects with the corresponding first set of routing paths 42 in the control-routing layer 16. Similarly, the second ASIC controller 44 connects to the second set of routing paths 46 in the control-routing layer 16.

In the present specific embodiment, the various connecting paths 42, 46 connect the ASIC controllers 40, 44 to various circuit-tuning stubs 140 in the input switching network 24 and the output switching network 26. Additional circuit paths connect the first ASIC controller 40 and the second ASIC controller 44 to the input switches 2-32 and the output switches 68, 70, 76, respectively. For clarity, the control lines 42, 46 of FIG. 1 are not shown in FIG. 3.

Figure 4:
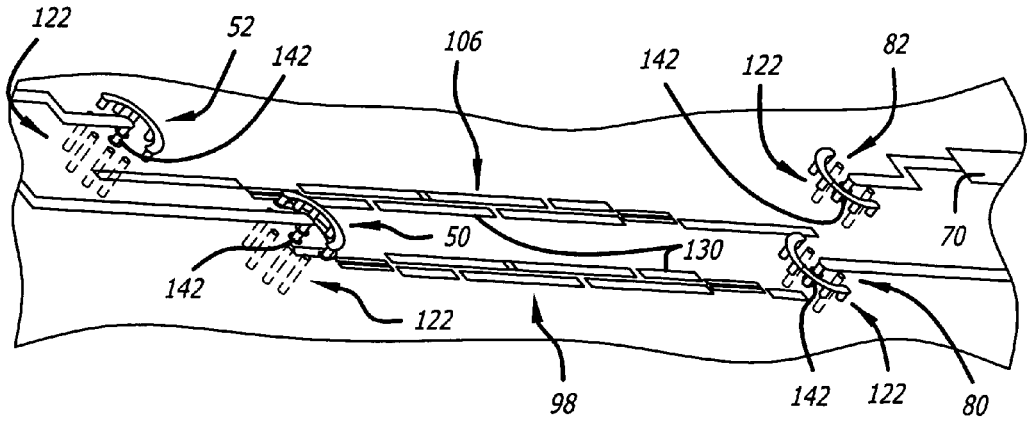
FIG. 4 is a magnified view illustrating exemplary vertical RF transitions of the programmable filter of FIG. 1.

FIG. 4 is a magnified view illustrating exemplary vertical waveguides 50, 52, 80, 82 of the programmable filter of FIG. 1. The vertical RF transitions 50, 52, 80, 82 are implemented via center circular waveguide sections 142 surrounded by strategically positioned mode suppression holes 122. The exact numbers, sizes, and positions of the mode suppression holes 122 are application specific and may be readily determined by those skilled in the art with access to the present teachings to meet the needs of a given application. Well-known methods for transitioning stripline and microstrip circuits to/from circular waveguides, such as the exemplary vertical RF transitions 50, 52, 80, 82, may be employed to implement embodiments of the present invention without departing from the scope thereof.

Figure 5:
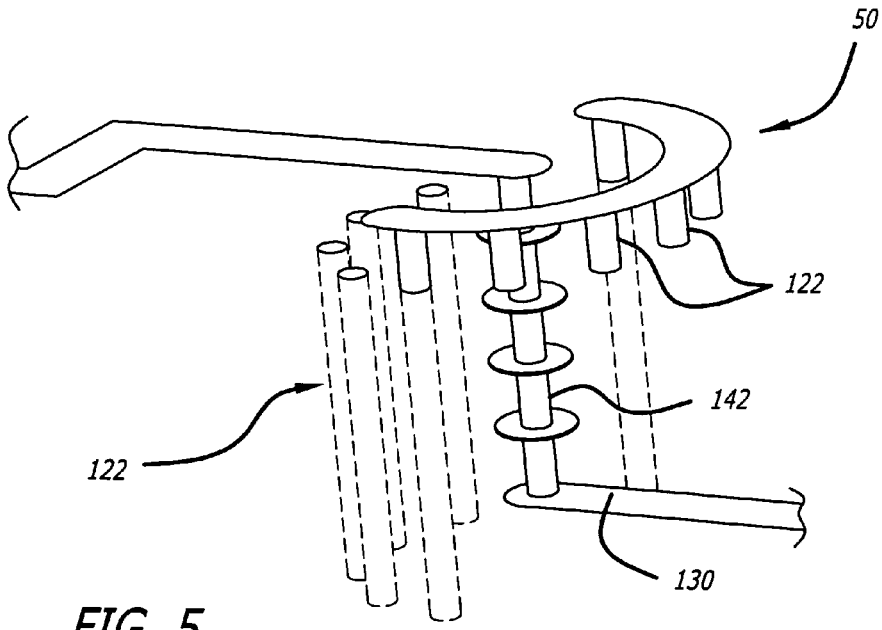
FIG. 5 is a further magnified view of an exemplary vertical RF transition of FIG. 4.

FIG. 5 is a further magnified view of an exemplary vertical RF transition of FIG. 4. The mode-suppression holes 122 and accompanying surface metalization facilitate coupling the microstrip switching network circuitry (see switching network 24 of FIG. 1) to the vertical circular waveguide 50 and constituent center circular waveguide 142 while suppressing undesirable microwave signal propagation modes.

Thus, the present invention has been described herein with reference to a particular embodiment for a particular application. Those having ordinary skill in the art and access to the present teachings will recognize additional modifications, applications, and embodiments within the scope thereof. It is therefore intended by the appended claims to cover any and all such applications, modifications and embodiments within the scope of the present invention.

Accordingly,

What is claimed is:

1. A multilayer signal processing system comprising:

first means for receiving an input signal and selectively routing said input signal onto a first signal path wherein said first means includes an input microstrip switching network in communication with one or more controllers for selectively switching said input signal onto one of plural input signal paths, said switching network disposed on a switching layer;

second means for routing said input signal along said first signal path vertically through one or more horizontal layers to a first circuit component that provides an adjusted signal in response to receipt of said input signal wherein said one or more horizontal layers include one or more groundplane layers and wherein said second means further includes a first input waveguide extending from said input switching network vertically through at least one horizontal groundplane layer and to an input end of said first circuit component;

third means for outputting said adjusted signal, wherein said third means includes a first output waveguide extending from an output end of said first circuit component and vertically through said at least one horizontal groundplane layer and to an output microstrip switching network disposed on said switching layer;

one or more controllers coupled to said input switching network and/or to said output switching network, said one or more controllers being adapted to activate or select a desired circuit component disposed on said circuit layer in response to a given operational mode of said multilayer signal processing system;

wherein said first circuit component is a stripline circuit component that is disposed on a circuit layer positioned between a first groundplane layer and a second groundplane layer, said first groundplane layer and said second groundplane layer corresponding to said at least one horizontal groundplane layer, wherein said circuit layer includes plural circuit components, each coupled to a respective input waveguide and output waveguide that extend vertically through said first groundplane layer to said input switching network and said output switching network, respectively, wherein said first input waveguide, said first output waveguide, and said each respective input waveguide and output waveguide are equipped with mode-suppression holes that parallel said waveguides, said waveguides being circular waveguides; and one or more additional circuit layers disposed substantially adjacent to and parallel to said second groundplane layer on a side of said second groundplane layer opposite said circuit layer, wherein said one or more additional circuit layers include one or more additional microwave filters disposed therein or thereon.

2. The system of claim 1 further including a control-routing layer positioned between said switching layer and said first groundplane layer, said control-routing layer including signal paths for routing control signals from said one or more controllers to said input switching network and said output switching network.

3. The system of claim 1 wherein said first circuit component is a microwave filter.

4. A system for enhancing isolation between an input and an output of a circuit comprising:

a first groundplane layer;

a second groundplane layer approximately parallel to said first groundplane layer;

a circuit element disposed between said first groundplane layer and said second groundplane layer;

an input waveguide extending through a plane of said first groundplane layer and coupling to an input end of said circuit element;

an output waveguide extending through a plane of said first groundplane layer and coupling to an output end of said circuit element;

a switching layer positioned approximately parallel to and adjacent to said first groundplane layer on a side of said first groundplane layer opposite said second groundplane layer, wherein said input waveguide and said output waveguide extend through said switching layer, said input waveguide and said output waveguide coupling to an input network and an output network, respectively, that are disposed on said switching layer, wherein said circuit element is dispose on a first circuit layer, said first circuit layer further including plural circuit elements, each of said plural circuit element coupled to a respective input waveguide and output waveguide, said input waveguide and output waveguide extending through said first groundplane layer and said switching layer and coupling to said input switching network and said output switching network, respectively;

a second circuit layer positioned approximately parallel to said second groundplane layer and positioned on a side of said second groundplane layer opposite said first groundplane layer, wherein said second circuit layer includes plural additional circuit elements, each additional circuit element coupled to said input switching network and said output switching network on said switching layer via additional waveguides extending through said second groundplane layer said first circuit layer, said first groundplane layer, and said switching layer;

a controller for selectively controlling switches of said input switching network and/or said output switching network to direct an input signal through a desired circuit element dispose on said first circuit layer or said second circuit layer and to direct a resulting output signal of said desired circuit element to an output of said output switching network; and a control layer for distributing control signals from said controller to said input switching network and/or said output switching network, said control layer positioned between said switching layer and said first groundplane layer.

5. The system of claim 4 wherein said circuit elements disposed on said first circuit layer and said additional circuit elements disposed on said second filter layer are microwave filters adapted to filter a predetermined microwave frequency.

6. The system of claim 5 wherein said controller produces control signals to control said input switching network and/or said output switching network based on a frequency of an input signal provided to said input switching network.

* * * * *